United States Patent [19]

Noguchi

[11] 4,088,092

[45] May 9, 1978

[54] TONER DENSITY SENSING APPARATUS FOR ELECTROSTATIC COPYING MACHINE

[75] Inventor: Koichi Noguchi, Tokyo, Japan

[73] Assignee: Ricoh Co., Ltd., Tokyo, Japan

[21] Appl. No.: 790,468

[22] Filed: Apr. 25, 1977

[30] Foreign Application Priority Data

Apr. 28, 1976 Japan ..... 51/48897

[51] Int. Cl.[2] ..... G03G 15/09

[52] U.S. Cl. ..... 118/7; 118/646

[58] Field of Search ..... 118/653, 7, 9, 646

[56] References Cited

U.S. PATENT DOCUMENTS

| | | | |
|---|---|---|---|
| 3,233,781 | 2/1966 | Grubbs | 118/9 X |
| 3,572,551 | 3/1971 | Gillespie | 118/646 X |
| 3,587,521 | 6/1971 | Rubenstein et al. | 118/9 X |
| 3,707,134 | 12/1972 | Gawron | 118/9 X |
| 3,802,381 | 4/1974 | O'Neill et al. | 118/9 X |
| 3,821,938 | 7/1974 | Bacon et al. | 118/7 |
| 3,835,811 | 9/1974 | Eto | 118/7 X |
| 3,876,116 | 4/1975 | Kushima | 118/7 X |
| 3,892,672 | 7/1975 | Gawron | 118/7 X |
| 3,970,036 | 7/1976 | Baer et al. | 118/7 |

*Primary Examiner*—Mervin Stein
*Assistant Examiner*—Andrew M. Falik
*Attorney, Agent, or Firm*—David G. Alexander

[57] ABSTRACT

A coil is provided to a developing tank containing a toner mixture consisting of ferromagnetic carrier particles and non-magnetic toner particles in such a manner as to be magnetically coupled with the mixture. The coil constitutes a frequency determining element of an oscillator. The inductance of the coil and thereby the frequency of the oscillator vary in accordance with the toner density or proportion of the toner particles in the mixture. An FM demodulator comprising a phase locked loop produces an output signal having a magnitude corresponding to the oscillator frequency and thereby the toner density. An electrically actuated valve is opened to supply more toner particles to the mixture when the toner density drops below a predetermined value.

15 Claims, 7 Drawing Figures

TONER DENSITY SENSING APPARATUS FOR ELECTROSTATIC COPYING MACHINE

BACKGROUND OF THE INVENTION

The present invention relates to a toner density sensing apparatus for an electrostatic copying machine.

In an electrostatic copying machine to which the present invention constitutes a substantial improvement, a photoconductive drum is electrostatically charged and radiated with a light image of an original document, thereby forming an electrostatic image through localized photoconduction. A magnetic brush applies a toner substance or mixture to the drum which develops the electrostatic image to form a toner image. The toner image is transferred and fixed to a copy sheet to form a permanent reproduction of the original document.

The toner mixture comprises ferromagnetic carrier particles and black colored non-magnetic toner particles, the toner particles being formed of a resinous powder or the like. The purpose of the carrier particles is to form the magnetic brush which applies the toner particles to the drum. Whereas the toner particles are consumed during copying, the carrier particles are not.

It is therefore necessary to replenish the toner particles in the toner mixture to replace those which are consumed during copying. The supply of replenishment rate must be such that the toner density, herein defined as the proportion of toner particles in the toner mixture, remains constant. If the toner density is too small or too large, the copies will be too light or too dark respectively. Whereas the replenishment rate may be predetermined, such is difficult and generally impossible to determine with acceptable precision in partical application.

For this reason a sensor is necessary which gives an accurate indication of the toner density so that the replenishment rate may be accurately adjusted in an instantaneous manner. Japanese patent publication No. 46-8280 teaches the provision of an electromagnetic coil provided in the toner mixture, the inductance of which corresponds to the toner density since the coil and toner are magnetically coupled. Similarly, Japanese patent publication No. 50-99522 teaches how the current flow through such a coil also corresponds to the toner density.

Although the toner density does correspond to the inductance and current flow through such a coil, measurement thereof for control purposes requires disproportionately complex and expensive circuitry to attain the required precision.

For this reason it has been further proposed in the prior art to provide the coil as one of the frequency determining elements of an oscillator in such a manner that the oscillator fequency corresponds to the inductance of the coil and thereby the toner density. This particular prior art system utilizes a separate local oscillator to produce a reference frequency . The two oscillator frequencies are sampled alternately, and slope detection is utilized to produce a signal corresponding to the toner density. This arrangement is not completely acceptable since the local oscillator adds unnecessarily to the complexity and cost of the circuitry and must be maintained at a precise frequency, thereby requiring expensive crystals control. As another disadvantage, the slope detection circuit is quite sensitive to variations in ambient conditions and is difficult to adjust accurately.

SUMMARY OF THE INVENTION

In accordance with the present invention, a coil is provided to a developing tank of an electrostatic copying machine which contains a toner mixture consisting of ferromagnetic carrier particles and non-magnetic toner particles in such a manner as to be magnetically coupled with the mixture. The coil constitutes a frequency determining element of an oscillator. The inductance of the coil and thereby the frequency of oscillation vary in accordance with the toner density or the proportion of the toner particles in the mixture. An FM demodulator comprising a phase locked loop produces an output signal having a magnitude corresponding to the oscillator frequency and thereby the toner mixture density. An electrically actuated valve is opened to supply more toner particles to the mixture when the toner density drops below a predetermined value.

It is an object of the present invention to provide a density sensing apparatus especially suited for determining the toner density in an electrostatic copying machine with precision.

It is another object of the present invention to provide a density sensing apparatus which is effective in operation and inexpensive to manufacture on a commercial production basis.

It is another object of the present invention to provide a density sensing apparatus which is stable and does not require precise adjustment.

It is another object of the present invention to provide a generally improved toner density sensing apparatus for an electrostatic copying machine.

Other objects, together with the foregoing, are attained in the embodiments described in the following description and illustrated in the accompanying drawing.

DESCRIPTION OF THE PREFERRED EMBODIMENTS

While the toner density sensing apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
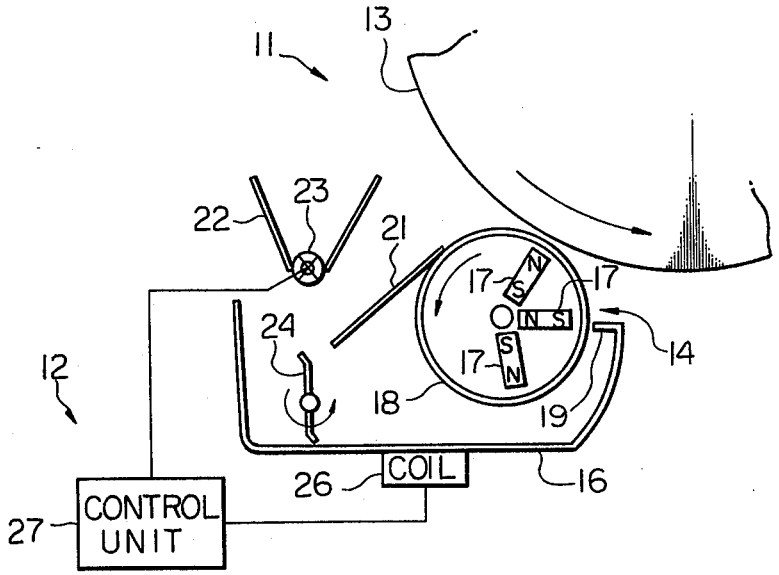
FIG. 1 is a fragmentary view of an electrostatic copying machine comprising a toner density sensing apparatus of the present invention.

Referring now to FIG. 1 of the drawing, an electrostatic copying machine is generally designated by the reference numeral 11 and comprises a toner density sensing apparatus embodying the present invention which is generally designated as 12. The copying machine 11 comprises a photoconductive drum 13 which is rotated counterclockwise at constant speed. Although not shown, a charging unit applies an electrostatic charge to the drum 13 and an exposure unit radiates a light image of an original document onto the surface of the drum 13 in a synchronized manner to form an electrostatic image on the drum 13 through localized photoconduction. A developing unit 14 applies a toner substance or mixture onto the drum 13 which develops the electrostatic image to form a toner image. Although not shown, a transfer unit transfers the toner image to a copy sheet and a fixing unit fixes the toner image to the copy sheet thereby providing a permanent reproduction of the original document. The drum 13 is then discharged and cleaned of residual toner substance prior to a subsequent copying operation.

The developing unit 14 comprises a toner container or developing tank 16 which can be of a non-magnetic material and which contains the toner mixture. A plurality of magnets 17 are mounted inside a non-magnetic cylinder 18 which is rotated counterclockwise at constant speed. Due to the force of the magnets 17 the toner mixture is attracted onto the surface of the cylinder 18 to form a rotating magnetic brush (not designated), which brushingly engages with the drum 13. The toner mixture comprises ferromagnetic carrier particles which form the magnetic brush and resinous non-magnetic toner particles which are black in color and are carried by the magnetic brush to the drum 13. The electrostatic charge of the image on the drum 13 attracts the toner particles to the dark image areas to which they adhere to form the toner image on the drum 13. A doctor blade 19 maintains the magnetic brush at a predetermined thickness.

The carrier particles, being electrically conductive, are not influenced by the electrostatic charge on the drum 13 and remain on the cylinder 18. These carrier particles are removed from the cylinder 18 after brushing engagement with the drum 13 by a scraper blade 21 and returned thereby to the tank 16.

Since the toner particles are consumed by the copying operation they must be replenished in order to maintain the toner density constant. The toner density is herein construed to mean the proportion of toner particles in the mixture. For this reason, fresh toner particles are supplied into a hopper 22 disposed above the tank 16. An electrically actuated valve 23 is opened upon application of an electrical signal to allow the fresh toner substance to be supplied into the tank 16 from the hopper 22 therethrough. An agitator 24 is rotated counterclockwise to mix the carrier particles and toner particles together and generally homogenize the toner mixture.

As discussed hereinabove it is necessary to supply the correct amount of toner particles into the developing tank 16 to maintain the toner density constant. To accomplish this function, the present toner density sensing apparatus 12 comprises an electromagnetic coil 26 which is mounted on the bottom of the developing tank 16. The coil 26 is connected through a control unit 27 to control the valve 23.

The coil 26 is magnetically coupled with the toner mixture in the developing tank 16 in such a manner that the inductance of the coil 26 varies in accordance with the toner density. As will be described in detail hereinbelow, the coil 26 constitutes a frequency determining element of an oscillator in the control unit 27 so that the frequency of the oscillator corresponds to the toner density. When the toner density drops below a predetermined value, the control unit 27 controls the valve 23 to open and supply fresh toner substance into the developing tank 16 for replenishment of the toner substance consumed by the copying precess.

Figure 2:
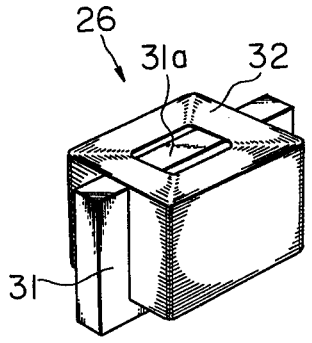
FIG. 2 is a perspective view of an electromagnetic coil of the present apparatus.
Figure 3:
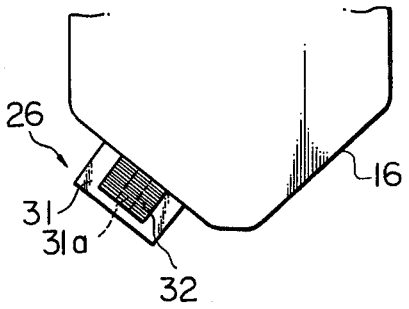
FIG. 3 is a plan view showing the installation of the coil of FIG. 2 on a developing tank of the copying machine.

The coil 26 is shown in FIGS. 2 and 3 as comprising an E-shaped laminated core 31 and a winding 32 would around the inner leg 31*a* of the core 31. With this arrangement, the developing tank 16 and the toner mixture therein are magnetically coupled with the coil 26 to effectively constitute extensions of the core 31.

As the toner density increases, the effective inductance of the coil 26 decreases. With the coil 26 constituting an element of a resonant circuit of the oscillator in the control unit 27, the decreased inductance causes the frequency of oscillation to increase. Conversely, as the toner density decreases, the effective inductance of the coil 26 increases and the frequency of oscillation decreases. When the oscillation frequency decreases below the predetermined value corresponding to the optimum toner density, the control unit 27 applies the electrical signal to the valve 23 causing the same to open and supply toner particles into the developing tank 16.

Figure 4:
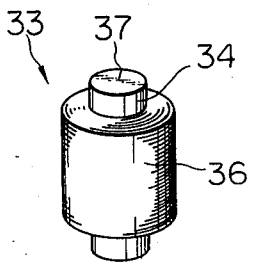
FIG. 4 is a perspective view of another electromagnetic coil.
Figure 5:
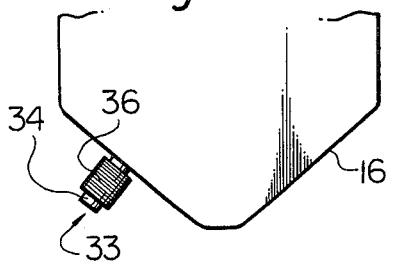
FIG. 5 is a plan view showing the coil of FIG. 4 installed on a developing tank of the copying machine.

Another coil 33 which may be used instead of the coil 26 is shown in FIGS. 4 and 5. The coil 33 comprises a non-magnetic cylindrical bobbin 34 around which is wound a winding 36. A ferromagnetic core 37 may or may not be provided in the bobbin 34.

Although the coils particularly shown and described herein are adapted to be mounted on the outside of the developing tank 16, the invention may also be practiced by providing the coil inside the tank 16 immersed in the toner mixture. The coil 33 with the core 37 omitted may be mounted inside the developing tank 16 and the toner mixture allowed to fill the bobbin 34.

Figure 6:
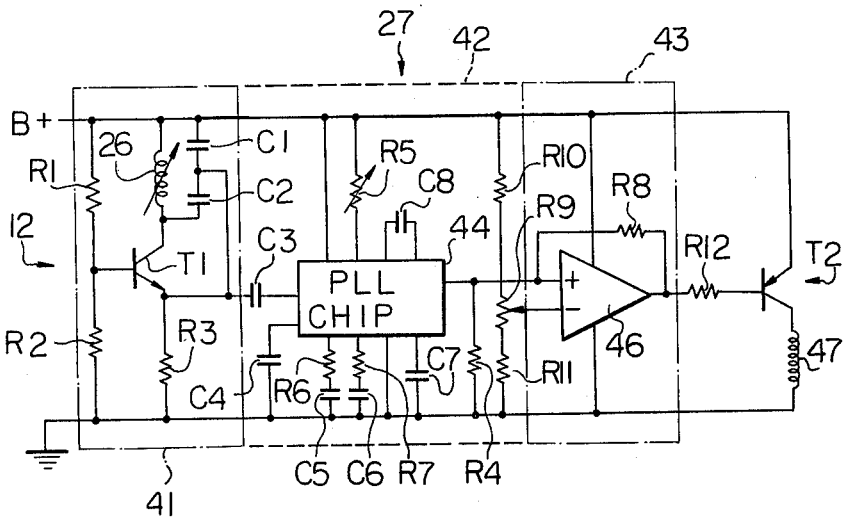
FIG. 6 is an electrical schematic diagram of the present density sensing apparatus.
Figure 7:
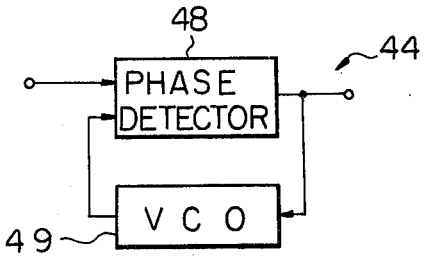
FIG. 7 is a schematic block diagram of a phase locked loop of the density sensing apparatus.

One preferred embodiment of the present density sensing apparatus 12 is shown in detail in FIGS. 6 and 7. The control unit 27 comprises an oscillator 41, an FM demodulator in the form of a phase locked loop 42 and an actuator 43. The oscillator 41 is of the Colpitts type and comprises an NPN transistor T1. A voltage divider comprising resistors R1 and R2 connected between a positive DC source B+ and ground provide fixed bias for the base of the transistor T1. An emitter resistor R3 is connected between the emitter of the transistor T1 and ground. A parallel resonant circuit is connected between the collector of the transistor T1 and B+ consisting of the coil 26 and two capacitors C1 and C2 connected in series. Feedback is provided by tapping the junction of the capacitors C1 and C2 and connecting the same to the emitter of the transistor T1.

The phase locked loop (PLL) 42 comprises an integrated circuit chip which is designated as 44. The output of the oscillator 41 is taken from the emitter of the transistor T1 and connected to the PLL chip 44 through a coupling capacitor C3. The output of the chip 44 is developed across an output resistor R4. Also illustrated are a variable resistor R5, fixed resistors R6 and R7 and capacitors C4, C5, C6, C7 and C8 which are connected to the chip 44 to set the base frequency, bandwidth, response speed, capture and pull-in range and the like and are not relevant to the scope of the present disclosure.

The actuator 43 comprises an operational amplifier 46 which is connected to constitute a voltage comparator. The output of the chip 44 is connected to a non-inverting input of the operational amplifier 46. A feedback resistor R8 is connected between the output and non-inverting input of the operational amplifier 46. A reference voltage is developed at the slider of a potentiometer R9 which is connected in series with fixed resistors R10 and R11 between B+ and ground. The reference voltage is applied to the inverting input of the operational amplifier 46 and is adjustable by means of the potentiometer R9. The output of the operational amplifier 46 is connected through a resistor R12 to the base of a PNP driver transistor T2. The emitter of the transistor T2 is connected to B+ and the collector of the transistor T2 is connected through a solenoid coil 47 of the valve 23 to ground.

In operation, the frequency of the oscillator 41 varies in correspondence with the toner density and thereby the inductance of the coil 26 as described hereinabove, with the output of the oscillator 41 being applied to the phase locked loop 42. As shown in FIG. 7, the PLL chip 44 comprises a phase detector 48 and a voltage controlled oscillator (VCO) 49. The phase detector 48 compares the phases of the signals from the oscillator 41 and the VCO 49 and produces an output signal corresponding to the phase difference. This output signal is applied to the input of the VCO 49 thereby adjusting the frequency thereof to eliminate the phase difference. In a very short period of time the phase locked loop 44 locks in on the frequency of the oscillator 41 and the output of the phase detector 48 which constitutes the output of the phase locked loop 44 becomes a DC signal having a magnitude corresponding to the frequency of the oscillator 41 and thereby the inductance of the coil 26 and the toner density.

The reference voltage at the slider of the potentiometer R9 is adjusted to correspond to the optimum toner density. When the toner density is below the predetermined value and the output of the phase locked loop 44 is below the reference voltage the operational amplifier 46 produces a low output which turns on the transistor T2 and energizes the solenoid coil 47 to open the valve 23 and supply more toner particles into the tank 16. When the toner density increases to the extent that the output of the phase locked loop 44 exceeds the reference voltage, the operational amplifier 46 produces a high output which turns off the transistor T2 and de-energizes the solenoid coil 47 thereby closing the value 23 and terminating the supply of toner particles.

In summary, it will be seen that the present invention provides a toner density sensing and control apparatus which precisely senses and maintains the toner density at the predetermined optimum value. Although the present apparatus is specifically designed for use in an electrostatic copying machine, it is applicable to any type of situation in which the density of a ferromagnetic mixture comprising a ferromagnetic component and a non-magnetic component must be sensed or measured. Many modifications will become possible for those skilled in the art after receiving the teachings of the present disclosure without departing from the scope thereof. As a typical example, the value of the resistor R8 may be selected such as to provide the operational amplifier 46 with a specified degree of hysterisis.

What is claimed is:

1. A density sensing apparatus for sensing a density of a powdered ferromagnetic mixture in a container, comprising, an oscillator including a coil provided to the container so as to be magnetically coupled with the mixture, the oscillator being constructed such that an inductance of the coil and thereby a frequency of the oscillator are corresponding functions of said density; and a demodulator for producing an electrical signal having a magnitude corresponding to said frequency and thereby said density, the demodulator comprising a phase locked loop.

2. A density sensing apparatus as in claim 1, in which the coil is mounted to the container in such a manner as to be magnetically coupled with the mixture through the container.

3. A density sensing apparatus as in claim 2, in which the container is formed of a non-magnetic material.

4. A density sensing apparatus as in claim 1, in which the coil comprises a ferromagnetic core.

5. A density sensing apparatus as in claim 1, in which the mixture comprises a ferromagnetic component and a non-magnetic component, the apparatus further comprising supply means for supplying the non-magnetic component into the container and actuator means responsive to the demodulator for controlling the supply means in accordance with said density.

6. A density sensing apparatus as in claim 5, in which said density is constituted by a relative proportion of the non-magnetic component in the mixture, the actuator means actuating the supply means when said density is below a predetermined value and de-actuating the supply means when said density is above the predetermined value.

7. A density sensing apparatus as in claim 5, in which the actuator means comprises a voltage comparator.

8. A density sensing apparatus as in claim 7, in which the voltage comparator comprises an operational amplifier.

9. A density sensing apparatus as in claim 5, in which the supply means comprises an electrically actuated supply valve controlled by the actuator means.

10. A density sensing apparatus for sensing a density of a powdered ferromagnetic mixture in a container, comprising:

an oscillator including a coil provided to the container so as to be magnetically coupled with the mixture, the oscillator being constructed such that an inductance of the coil and thereby a frequency of the oscillator are corresponding functions of said density;

a demodulator for producing an electrical signal having a magnitude corresponding to said frequency and thereby said density;

the mixture comprising a ferromagnetic component and a non-magnetic component, the apparatus further comprising supply means for supplying the non-magnetic component into the container and actuator means responsive to the demodulator for controlling the supply means in accordance with said density, the actuator means comprising a voltage comparator which includes an operational amplifier.

11. A density sensing apparatus as in claim 10, in which the coil is mounted to the container in such a manner as to be magnetically coupled with the mixture through the container.

12. A density sensing apparatus as in claim 11, in which the container is formed of a non-magnetic material.

13. A density sensing apparatus as in claim 10, in which the coil comprises a ferromagnetic core.

14. A density sensing apparatus as in claim 10, in which said density is constituted by a relative proportion of the non-magnetic component in the mixture, the actuator means actuating the supply means when said density is below a predetermined value and de-actuating the supply means when said density is above the predetermined value.

15. A density sensing apparatus as in claim 10 in which the supply means comprises an electrically actuated supply valve controlled by the actuator means.

* * * * *